US007841137B2

(12) United States Patent
Rosten et al.

(10) Patent No.: US 7,841,137 B2
(45) Date of Patent: Nov. 30, 2010

(54) INSULATION BLOCK AND BAFFLE VENT FOR MANUFACTURED HOUSING

(75) Inventors: David B. Rosten, Isanti, MN (US); David J. Bonanni, Fleetwood, PA (US); Richard Pirino, Wyomissing, PA (US)

(73) Assignee: Brentwood Industries, Inc., Reading, PA (US)

( * ) Notice: Subject to any disclaimer, the term of this patent is extended or adjusted under 35 U.S.C. 154(b) by 25 days.

(21) Appl. No.: 12/041,811

(22) Filed: Mar. 4, 2008

(65) Prior Publication Data

US 2008/0216419 A1 Sep. 11, 2008

Related U.S. Application Data

(60) Provisional application No. 60/905,524, filed on Mar. 6, 2007.

(51) Int. Cl.
*E04B 7/00* (2006.01)

(52) U.S. Cl. ..... 52/95; 52/198; 52/199; 52/302.1

(58) Field of Classification Search ..... 52/94, 52/95, 96, 97, 98, 198, 199; 454/260
See application file for complete search history.

(56) References Cited

U.S. PATENT DOCUMENTS

| | | | | |
|---|---|---|---|---|
| 3,240,144 | A * | 3/1966 | Lind | 454/260 |
| 3,683,785 | A | 8/1972 | Grange | 454/250 |
| 3,863,553 | A | 2/1975 | Koontz | 454/260 |
| 4,096,790 | A * | 6/1978 | Curran | 454/260 |
| 4,185,433 | A | 1/1980 | Cantrell | 52/94 |
| 4,214,510 | A | 7/1980 | Ward | 454/260 |
| 4,446,661 | A | 5/1984 | Jonsson | 52/95 |
| 4,581,861 | A | 4/1986 | Eury | 52/95 |
| 4,611,443 | A | 9/1986 | Jorgensen | 52/95 |
| 5,007,216 | A | 4/1991 | Pearson | 52/94 |
| 5,596,847 | A | 1/1997 | Stephenson | 52/198 |
| 6,112,490 | A * | 9/2000 | Meyer | 52/407.3 |
| 6,347,991 | B1 * | 2/2002 | Bogrett et al. | 454/260 |
| 6,357,185 | B1 | 3/2002 | Obermeyer | 52/95 |
| 7,094,145 | B2 | 8/2006 | Rye | 454/366 |
| 7,302,776 | B2 * | 12/2007 | Duncan et al. | 52/95 |
| 7,458,189 | B2 * | 12/2008 | Pollack | 52/302.1 |
| 7,484,335 | B1 * | 2/2009 | Dunlap | 52/95 |
| 2005/0215192 | A1 * | 9/2005 | Rye et al. | 454/260 |
| 2007/0151176 | A1 * | 7/2007 | Mumaw et al. | 52/198 |
| 2008/0202041 | A1 * | 8/2008 | Dillon | 52/95 |
| 2008/0280554 | A1 * | 11/2008 | Kortuem et al. | 454/260 |
| 2010/0064602 | A1 * | 3/2010 | Moore | 52/95 |

* cited by examiner

*Primary Examiner*—David Dunn
*Assistant Examiner*—Adam Barlow
(74) *Attorney, Agent, or Firm*—Miller Law Group, PLLC

(57) ABSTRACT

An insulation block is utilized with a corresponding baffle vent having a transverse width that will span several roof rafters, as is provided for use with manufactured housing. The insulation block includes uniformly spaced vertical ribs that extend from one edge of the insulation block to the opposing edge thereof to stiffen the insulation block which is formed of vacuum molded polyvinyl chloride film. After the baffle panel is placed on top of the roof rafters, which is before the roof sheeting is applied, the insulation block is attached to the wall top plate with the top edge of the insulation block placed into engagement with the baffle vent. The top edge of the insulation block is configured to mate with the undulating configuration of the corresponding baffle vent, fitting between transversely extending stiffening ribs on the baffle vent, to prevent insulation from entering the soffit area.

16 Claims, 9 Drawing Sheets

Fig. 1
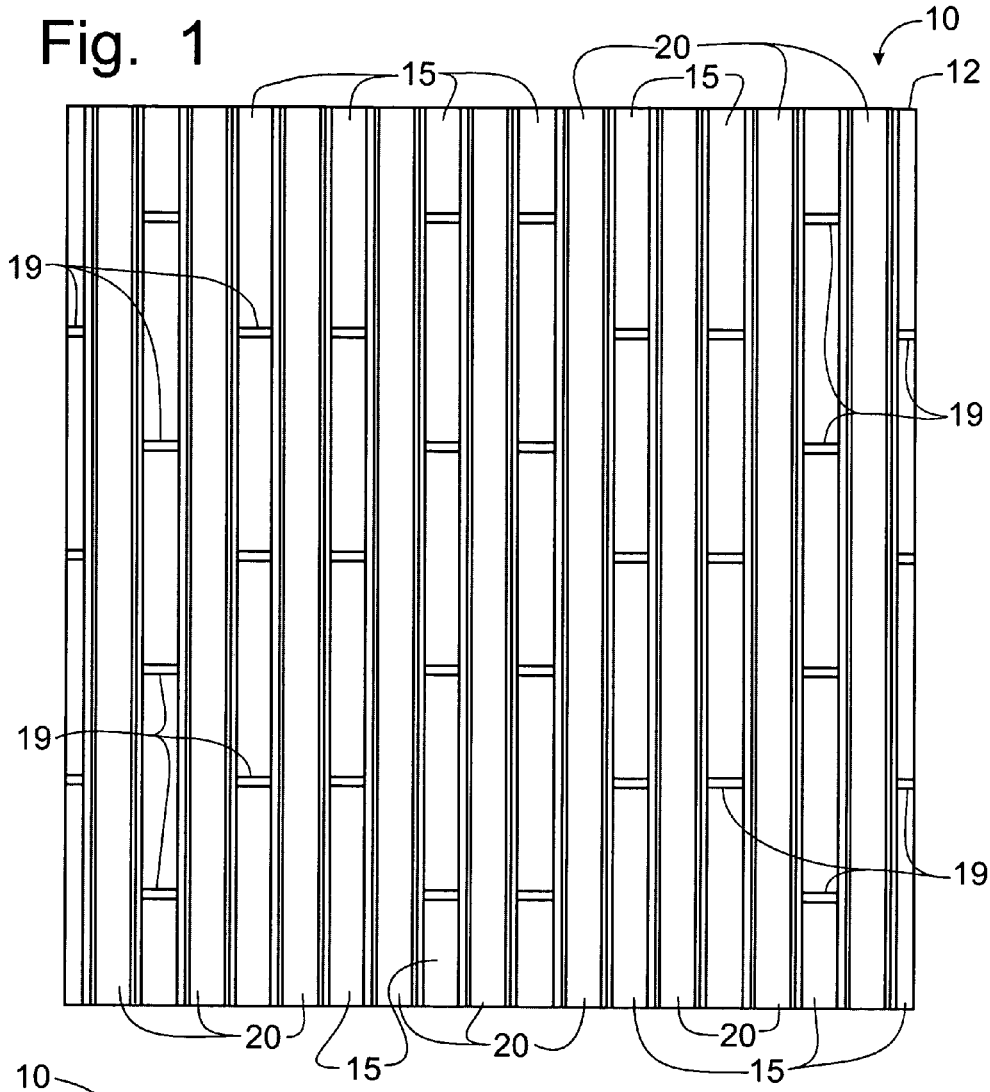
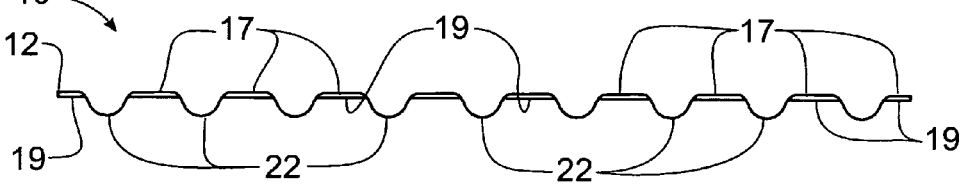
Fig. 2

Fig. 8
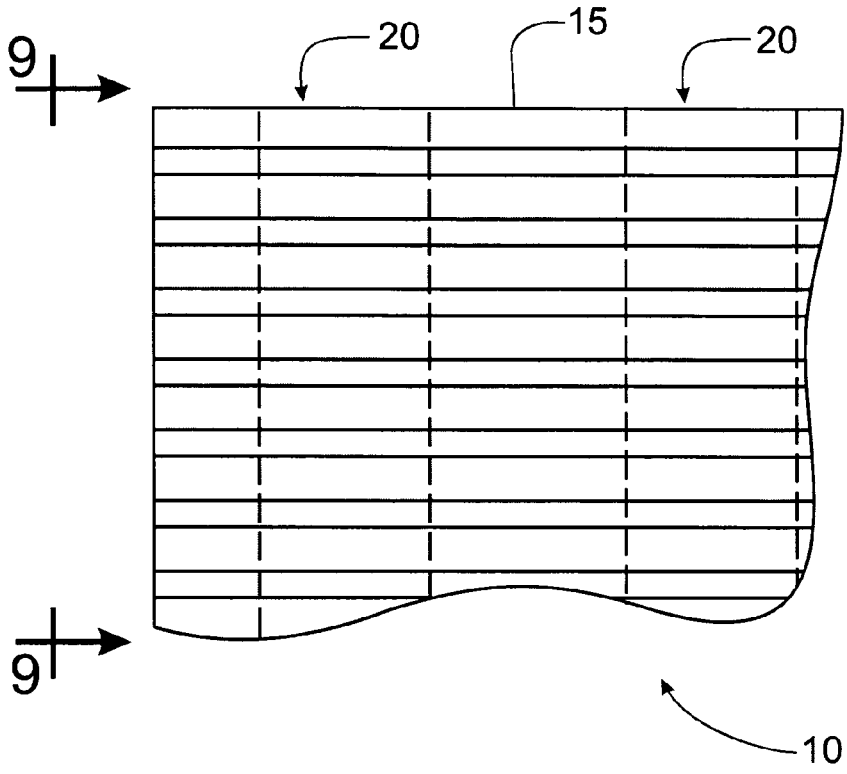
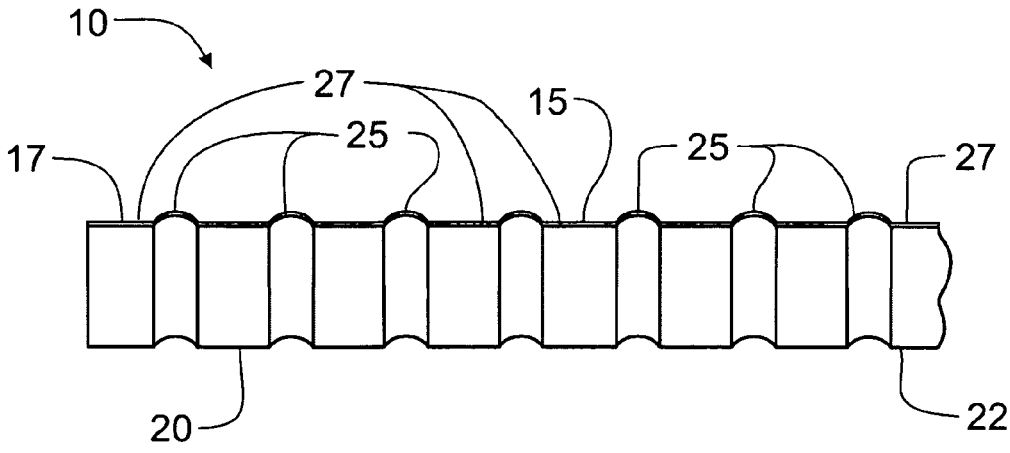
Fig. 9

Fig. 10
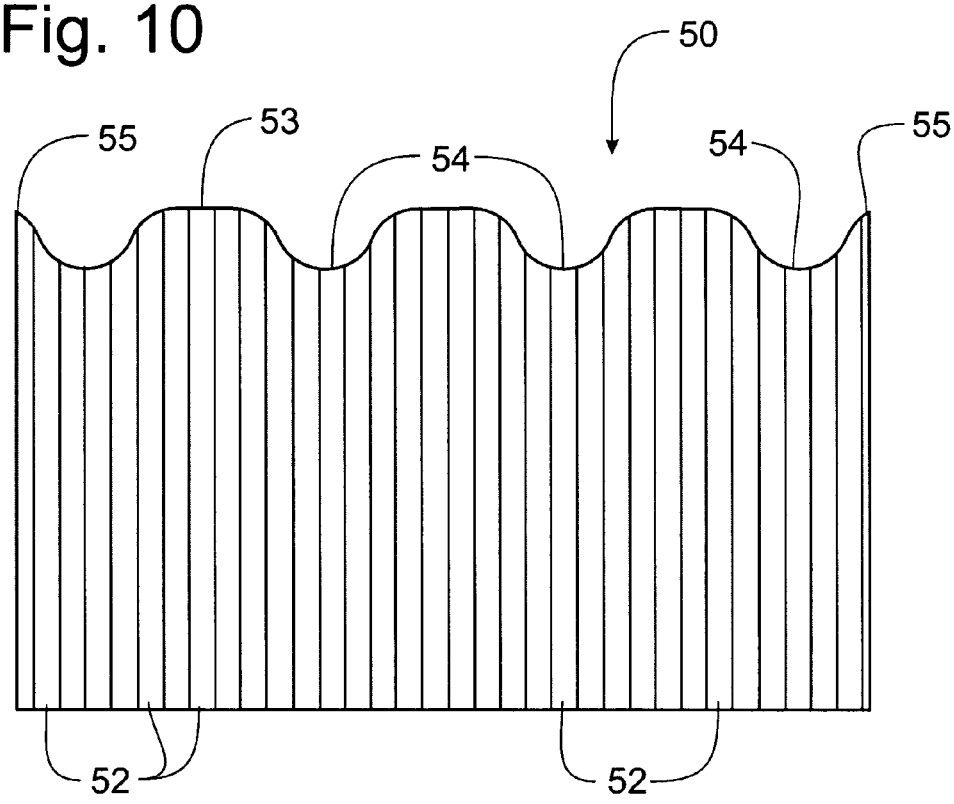
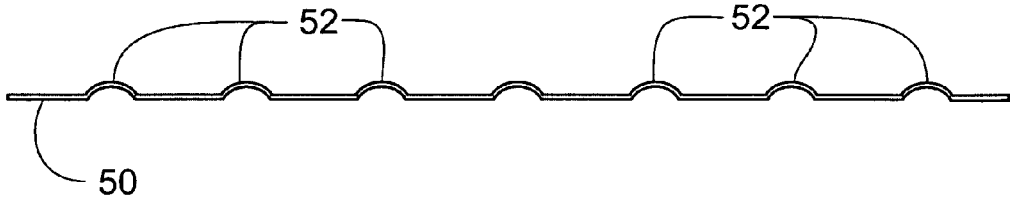
Fig. 11

Fig. 12
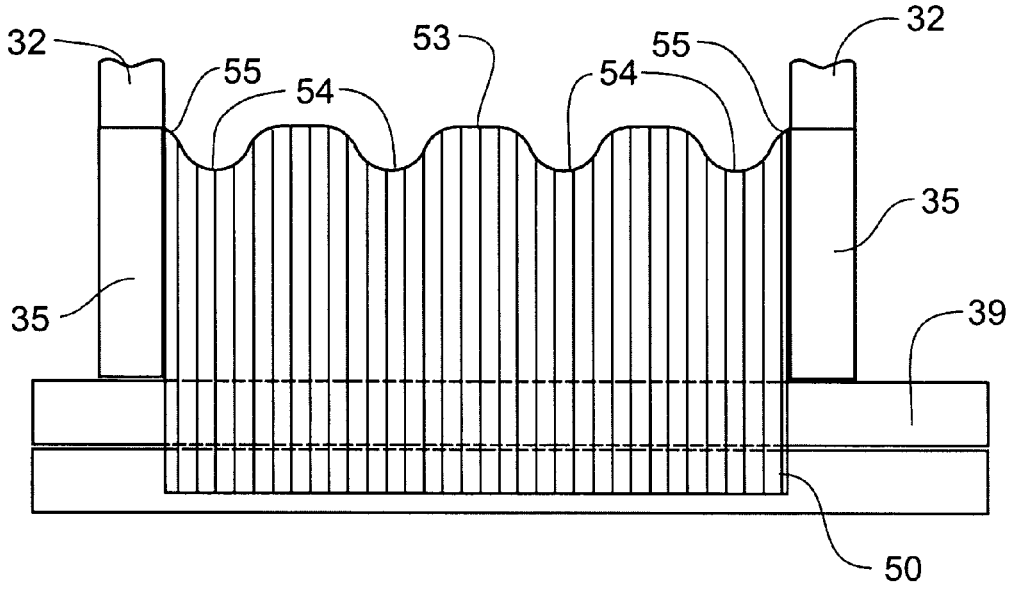
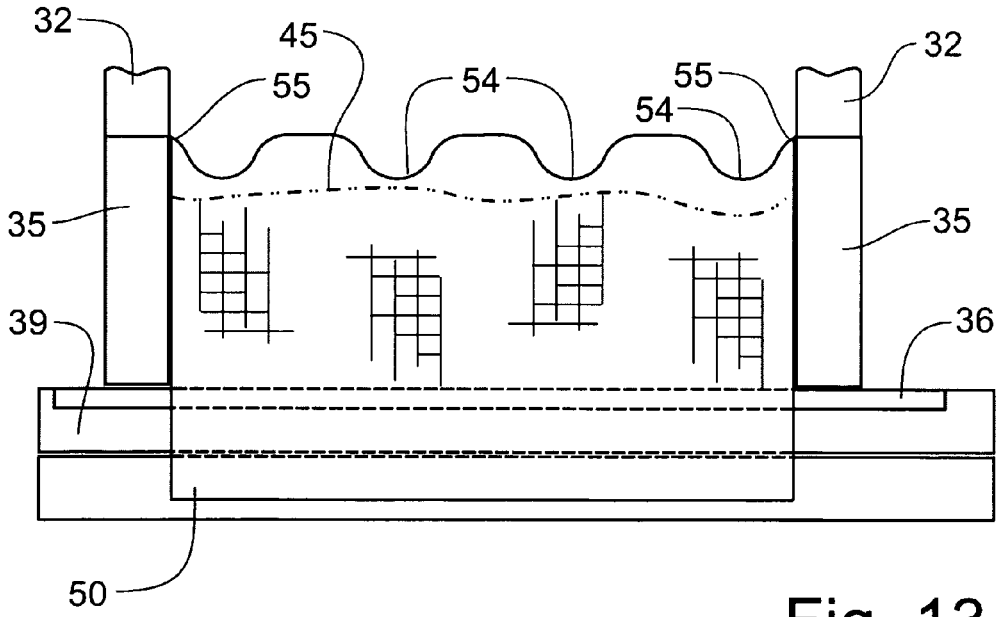
Fig. 13

Fig. 14
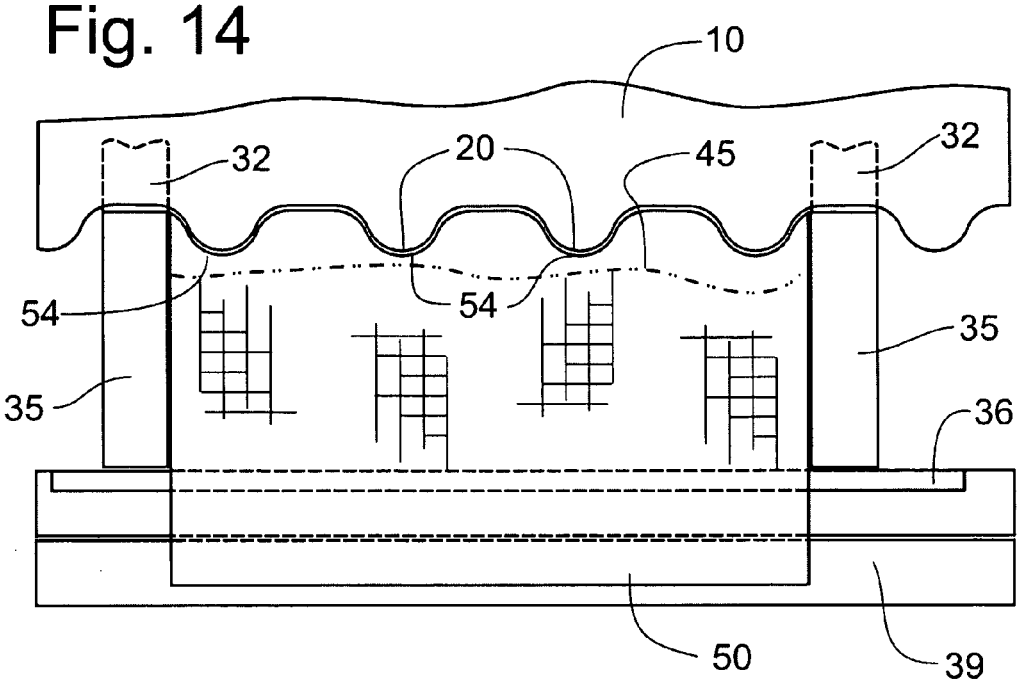
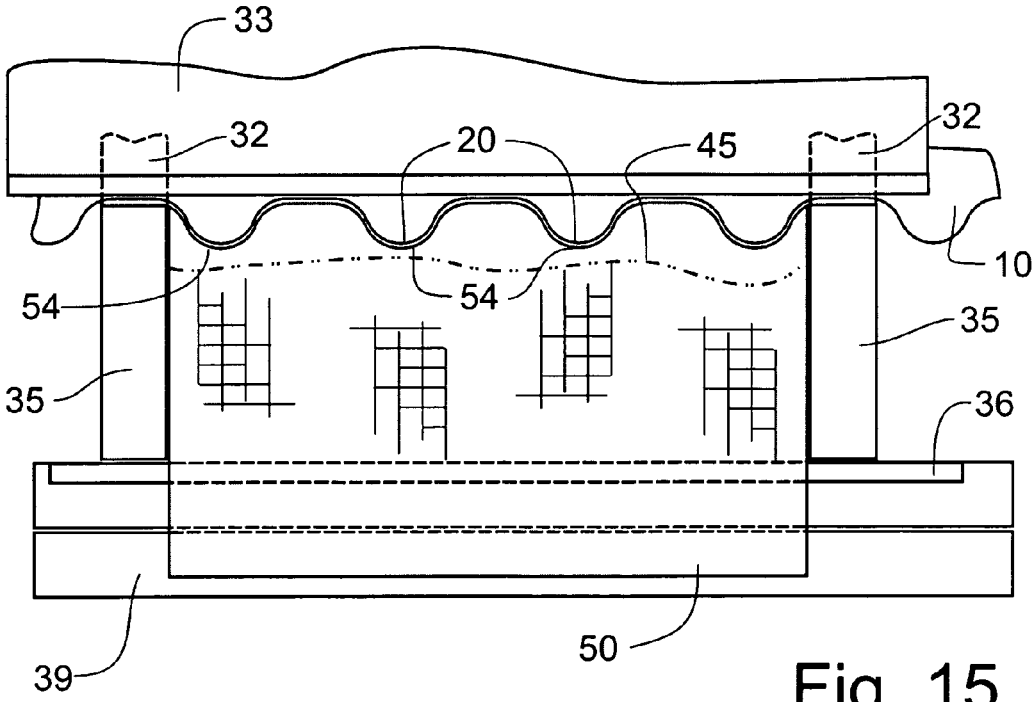
Fig. 15

INSULATION BLOCK AND BAFFLE VENT FOR MANUFACTURED HOUSING

CROSS-REFERENCE TO RELATED APPLICATIONS

This application claims domestic priority on U.S. Provisional Patent Application Ser. No. 60/905,524, filed on Mar. 6, 2007, the contents of which are incorporated herein by reference.

FIELD OF THE INVENTION

This invention relates generally to attic vent baffles commonly used in residential building structures to allow ventilation flow from soffit vents into an attic space for venting from the attic, and, more particularly to an insulation stop that is installed at the exterior wall where the roof rafters and joists are supported to cooperate with the baffle vent to contain insulation to allow the passage of ventilation air in a manner that is particularly adapted for use in the manufactured housing industry.

BACKGROUND OF THE INVENTION

Attic ventilation systems are typically used in residential buildings to provide proper ventilation of the attic space, which is desired to help prevent formation of condensation along the interior surface of the roof. Condensation can damage the attic insulation and the wooden structure of the building itself. Proper ventilation also helps to prevent premature melting of snow accumulated on a building roof, which can lead to the formation of ice on the roof that presents a safety hazard and can also lead to roof damage. Such attic ventilation systems will utilize vents placed into the underside of the soffit, which projects outwardly from the roof of the building and forms the overhang at the perimeter of the building roof. The intent of these attic ventilation systems is for air to travel through the soffit vents into the attic space and be discharged through an attic vent, which is typically placed at the apex of the roof.

The use of insulation in the attic to provide a barrier to the transmission of heat between the occupied portion of the building structure and the unoccupied attic portion of the building can restrict, or even prevent, the flow of air from the soffits to the roof vent at the apex of the roof. The insulation can be packed along the joists of the roof trusses to the soffits and not allow a passageway for the movement of air past the insulation into the portion of the attic above the insulation. Known construction of the insulation material can include cellulose, rock wool, fiberglass and expanded foam, the latter being used most often in manufactured housing, i.e. housing constructed in a factory and transported to the job site instead of being constructed at the job site. To maintain a discrete passageway for the movement of from the soffit, past the insulation barrier, and into the upper portion of the attic for discharge through the roof vent, baffle vents have been provided for attachment to the interior side of the roof to keep the insulation separated from the interior surface of the roof deck.

One embodiment of a baffle vent can be seen in U.S. Pat. No. 7,094,145, granted on Aug. 22, 2006, to Palle Rye, et al, and assigned to Brentwood Industries, Inc. The Rye baffle vent is stapled to the interior surface of the roof sheeting between the roof rafters and includes a tail portion that is bent in the vicinity of the soffit to form an insulation block that extends from the interior surface of the roof sheeting to engage the wall top plate. This baffle vent thus forms a barrier that prevents the movement of insulation into the soffit area and restricting the flow of air from the soffit into the attic. The structure of the baffle vent incorporates a series of convolution that are oriented parallel to the roof rafters to provide channels that define passageways for the movement of air past the insulation that is engaged against the baffle vent. In operation, the baffle vent utilizes the channels to keep the insulation away from the interior surface of the roof and establishes dedicated passages for the flow of air past the insulation along the interior surface of the roof sheeting.

Earlier configurations of baffle vents can be seen in U.S. Pat. No. 4,446,661, granted to Jan Jonsson, et al, on May 8, 1984, in which a corrugated sheet is fastened to the vertical surfaces of adjacent roof rafters to provide a plurality of longitudinally extending passageways for the movement of air past insulation in the roof. A major consideration in the design and manufacture of such baffle vents is the cost of such structures, particularly when taking into consideration the large square footage of the roofs of some residential buildings. Consequently, baffle vents have been fabricated extensively of foam or plastic material in narrow sheets that form self-supporting structures that can be handled and manipulated into position between the roof rafters for attachment against the interior surface of the roof sheeting. In U.S. Pat. No. 5,341,612, issued to Gary Robbins on Aug. 30, 1994, a baffle vent structure is formed of a thinner foam sheet material and includes a reinforced structure to prevent the vents from collapsing during shipping, handling and installation, as well as to prevent collapsing of the vents from compacted insulation which often is blown into attic areas of a building against the underside of the baffle vents.

Conventional residential construction affected at the job site will typically have the roof structure formed at the same time as the exterior shell of the building so as to get the building under roof to prevent the intrusion of foul weather into the interior of the building. The baffle vents described above are intended for use in such on-site construction techniques. Since the insulation is placed into the attic area long after the roof sheeting and shingles are added to the roof rafters, the baffle vents are formed to be placed between the roof rafters on the underside of the roof sheeting by attaching mounting flanged to either the vertical surfaces of the roof rafters, as is depicted in the aforementioned U.S. Pat. No. 4,446,661 to Jonsson, or the underside of the roof sheeting, as is depicted in U.S. Pat. No. 5,341,612 to Robbins. Generally, the baffle vents are installed as part of the installation of the insulation by contractors that specialize in the installation of insulation, rather than by the roofing contractor that will install the roof vent at the apex of the roof structure.

Manufactured housing is constructed in a factory setting where there is no pressing need to have the roof structure completed before the interior portions of the house are completed. As a result, the baffle vents can be installed on top of the roof rafters before the roof sheeting is fastened to the roof rafters. Generally, manufactured housing is formed with the interior drywall sheeting applied to the bottom side of the ceiling joists to form the inside ceiling of the housing before the roof is completed. The roof sheeting is then attached to the top surfaces of the roof rafters, followed by the application of the exterior roofing materials, typically fiberglass shingles. Insulation can then be installed between the joists on top of the drywall. While blanket fiberglass insulation or blown loose cellulose or fiberglass insulation can be used, expanded foam is often used in manufactured housing construction. The expansion rate of the foam places a substantial pressure on the baffle vent and will often collapse the passageways, resulting in the interruption of the air flow from the soffit past the insulation layer.

Blocking the opening between the joists and extending vertically from the wall top plate to the baffle vent beneath the roof sheeting is important to prevent the intrusion of insulation, particularly blown insulation or expanded foam insulation, into the soffit area, which would restrict the flow of ventilation air into the baffle vent for passage into the attic above the insulation blanket. In the manufactured housing industry, the insulation block is typically formed by rolling blanket fiberglass insulation material and stuffing the roll between the joists at the vicinity of the wall top plate. The baffle vent is then placed between the rafters before the insulation is blown in or expanded foam is injected into the area between the joists.

An example of a baffle vent that is adapted for use in the manufactured housing setting can be found in U.S. Pat. No. 5,596,847, granted to Michael Stephenson on Jan. 28, 1997. This baffle vent is formed with longitudinally extending ribs that are spaced on eight inch centers so that the single panel can be used on rafters whether spaced sixteen or twenty-four inches apart. A score line is formed on one of the interior ribs so that the excess eight inch strip can be removed if the baffle vent is used on rafters spaced at sixteen inched. In U.S. Pat. No. 4,096,790, issued on Jun. 27, 1978, to Laurence Curran, the baffle vent is formed to span across multiple roof rafters with a panel hanging down to engaged the wall top plate and form a barrier to restrict the passage of insulation into the soffit area. In the Curran baffle vent configuration, mounting ribs are spaced at intervals corresponding to the roof rafter structure on which the baffle vent is to be applied. Thus, to be used with sixteen inch and twenty-four inch rafter spacings, the Curran baffle vent would have to be provided in two different models.

The Stephenson baffle vent configuration, and particularly in the Curran baffle vent configuration, the spacing of the longitudinally extending ribs provides a wide span between the ribs to define large passageways for the movement of air along the interior surface of the roof sheeting. Unfortunately, this wide expanse of unreinforced passageway, particularly when the baffle vent is manufactured from foam or a thin plastic material to maintain cost considerations, is subjected to collapse, especially when used with expanding foam insulation techniques. If the passageway collapses, the baffle vent is not functional to allow the passage of air from the soffit past the insulation layer to the upper portions of the attic structure.

Providing a combination baffle vent and insulation block has been recognized in the prior art. For example, the apparatus disclosed in U.S. Pat. No. 5,007,216, issued to David Pearson on Apr. 16, 1991, is a cardboard device that can be folded and stapled in place between the rafters and tacked to the wall top plate. As with such prior art devices, this baffle and insulation stop combination is intended for installation after the roofing materials have been attached to the rafters. The installation of the Pearson baffle would be cumbersome and time consuming with respect to use in the manufactured housing industry where production speed is essential. Furthermore, such cardboard construction is not sufficiently rigid to consistently withstand the pressures of expanded foam insulation. Other similar prior art combination baffle and insulation stop devices can be seen in U.S. Pat. No. 4,611,443, granted to Ralph H. Jorgensen, et al., on Sep. 16, 1986; in U.S. Pat. No. 4,581,861, granted on Apr. 15, 1986, to Matthew Eury; in U.S. Pat. No. 4,214,510, granted to Bruce Ward on Jul. 29, 1980; in U.S. Pat. No. 4,185,433, granted on Jan. 29, 1980, to James Cantrell; and in U.S. Pat. No. 3,863,553, granted on Feb. 4, 1975, to Bryce Koontz.

In U.S. Pat. No. 6,357,185, issued to Keith Obermeyer, et al., on Mar. 19, 2002, a separate insulation stop member is disclosed as being cooperable with a baffle vent that is stapled to the underside of the roof sheeting to provide a barrier to the movement of insulation into the soffit area and to provide a flow of ventilation air from the soffit into the attic above the insulation layer. As with the combination baffle vent and insulation stop devices noted above, the Obermeyer insulation block is formed for installation after the construction of the roof materials onto the roof rafters. The cardboard insulation block is formed with various fold lines to fit between conventional 16 inch and 24 inch centered rafters and joists and includes staple tabs that fix the insulation block to the interior vertical face of the wall top plate, as well as to the vertical faces of the rafters and joists and the underside of the roof sheeting to fix the insulation block in place to resist the infiltration of insulation into the soffit. Furthermore, the Obermeyer insulation block is shaped to mate with the underside of the corresponding baffle block stapled to the underside of the roof sheeting, thus providing a barrier to insulation and establishing a flow path for ventilation air from the soffit into the attic past the insulation blanket.

Accordingly, it would be desirable to provide an insulation block that would be cooperable with a corresponding baffle vent structure, the combination of which would be particularly adapted for use in the manufactured housing industry to establish and maintain passageways for the movement of air from the building soffit past the insulation layer into the upper attic area for discharge from the attic through a roof vent. It would also be desirable that the baffle vent be formed in a manner to resist collapsing when expanded foam insulation material, or other similar insulation material that exerts a force onto the baffle vent, is installed against the insulation stop.

SUMMARY OF THE INVENTION

It is an object of this invention to overcome the disadvantages of the prior art by providing an insulation block that is cooperable with a baffle vent designed for use in manufactured housing.

It is another object of this invention to provide an insulation block that can be attached to the wall top plate to project upwardly therefrom to prevent insulation from passing into the soffit area of a manufactured house.

It is a feature of this invention that the insulation block is formed with undulating top edge that will mate with a corresponding baffle vent configuration.

It is an advantage of this invention that the insulation block and corresponding baffle vent can be placed on the roof rafters before the roof sheeting is placed on the rafters.

It is another feature of this invention that the insulation block is formed with alternating flat ribs and rounded valleys along the top edge thereof to mate with the configuration of the transverse width of the corresponding baffle vent.

It is another advantage of this invention that the insulation block is sized to fit between standard roof rafters.

It is still another feature of this invention that the insulation block is placed only between adjacent roof rafters irrespective of the width of the corresponding baffle vent.

It is another feature of this invention that the baffle vent is formed with vertically extending ribs that extend from one edge of the insulation block to the opposing edge.

If is yet another feature of this invention that the vertical ribs are spaced along the entire vertical height of the insulation block.

It is another advantage of this invention that the vertical ribs stiffen the insulation block to make the insulation block easier to deploy and to be strong enough to resist the weight of the insulation pressing against the insulation block.

It is a further feature of this invention that the vertical ribs extend uniformly along the entire transverse width of the insulation block.

It is a further advantage of this invention that the vertical ribs on the insulation block provides adequate stiffness to the insulation block for ease of deployment in a manufactured house operation.

It is yet another object of this invention to provide an insulation block for use in manufactured housing, which is durable in construction, inexpensive of manufacture, carefree of maintenance, facile in assemblage, and simple and effective in use.

These and other objects, features and advantages are accomplished according to the instant invention by providing an insulation block that can be utilized with a corresponding baffle vent having a transverse width that will span several roof rafters. The insulation block includes uniformly spaced vertical ribs that extend from one edge of the insulation block to the opposing edge thereof to stiffen the insulation block which is formed of vacuum molded polyvinyl chloride film. After the baffle panel is placed on top of the roof rafters, which is before the roof sheeting is applied, the insulation block is attached to the wall top plate with the top edge of the insulation block placed into engagement with the baffle vent. The top edge of the insulation block is configured to mate with the undulating configuration of the corresponding baffle vent, fitting between transversely extending stiffening ribs on the baffle vent, to prevent insulation from entering the soffit area.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a top plan view of a portion of the baffle vent incorporating the principles of the instant invention, the depicted baffle vent corresponding to a first stamping of the larger full sized baffle vent vacuum molded during the manufacturing process;

FIG. 2 is an end elevational view of the baffle vent segment depicted in FIG. 1 and being arranged as an orthogonal projection of FIG. 1;

FIG. 8 is a partial top plan view of an alternative ribbed configuration of the baffle vent;

FIG. 9 is an enlarged partial side elevational view of the baffle vent depicted in FIG. 8;

FIG. 10 is an elevational view of an insulation block member incorporating the principles of the instant invention;

FIG. 11 is an enlarged end view of the insulation block member depicted in FIG. 10;

FIG. 12 is a partial schematic cross-sectional view of a building structure having an insulation block member installed between a pair of ceiling joists at the wall top plate looking from the exterior of the building structure;

FIG. 13 is a partial schematic cross-section view similar to that of FIG. 12, but showing a subsequent step of the installation of the insulation against the insulation block member, the ribs of the insulation block member being removed for purposes of clarity;

FIG. 14 is a partial schematic cross-sectional view similar to that of FIG. 13, but showing the addition of the baffle vent having transversely extending ribs to interlock with the insulation block member;

FIG. 15 is a partial schematic cross-sectional view similar to that of FIG. 14, but showing the addition of the roof sheeting to trap the baffle vent between the roof sheeting and the rafters.

DETAILED DESCRIPTION OF THE PREFERRED EMBODIMENT

Referring to FIGS. 1-7, a baffle vent incorporating the principles of the instant invention can best be seen. The baffle vent 10 is preferably formed from polyvinyl chloride (PVC) film (not shown) having a thickness of about 12 to 16 mils through a conventional vacuum molding process in which the film is placed over a mold (not shown) and heated. A vacuum applied to the film draws the PVC film over a mold to cause the PVC film to assume the shape of the mold. In the preferred embodiment, the mold would have dimensions of about 39 inches by about 36 inches. Since the PVC film is supplied from a continuous roll, the baffle vent 10 can be formed in sequential segments 12, which are then severed along the center of a rib 15, as will be described in greater detail below, to form the complete baffle vent 10.

Figure 3:
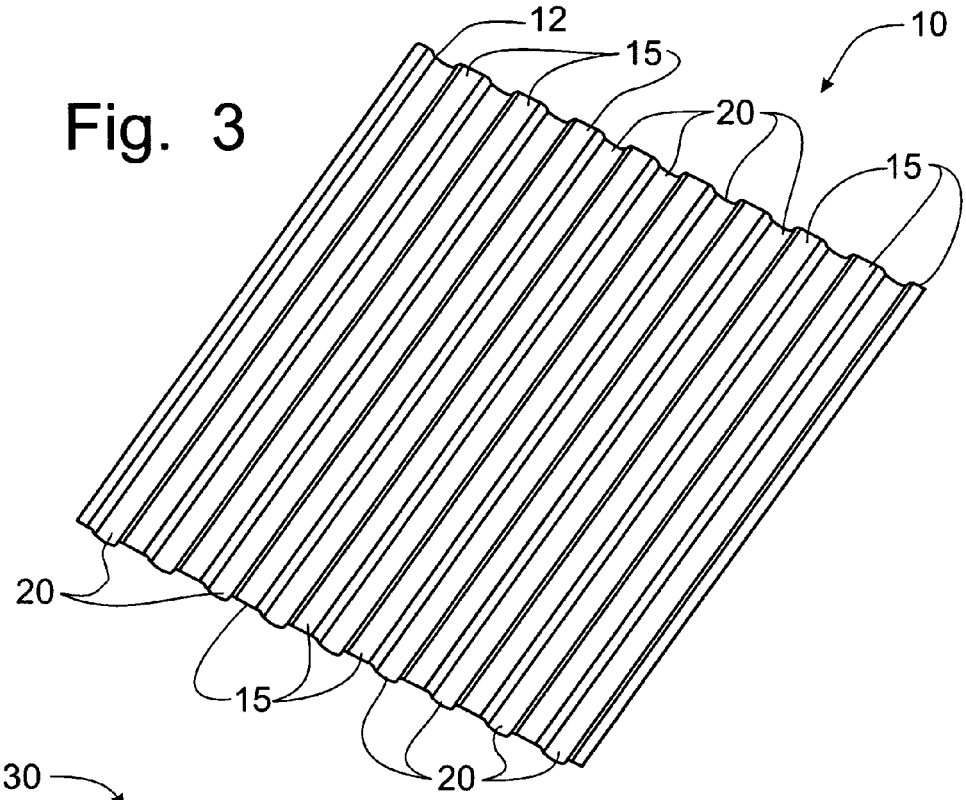
FIG. 3 is a perspective view of the baffle vent segment depicted in FIG. 1.
Figure 4:
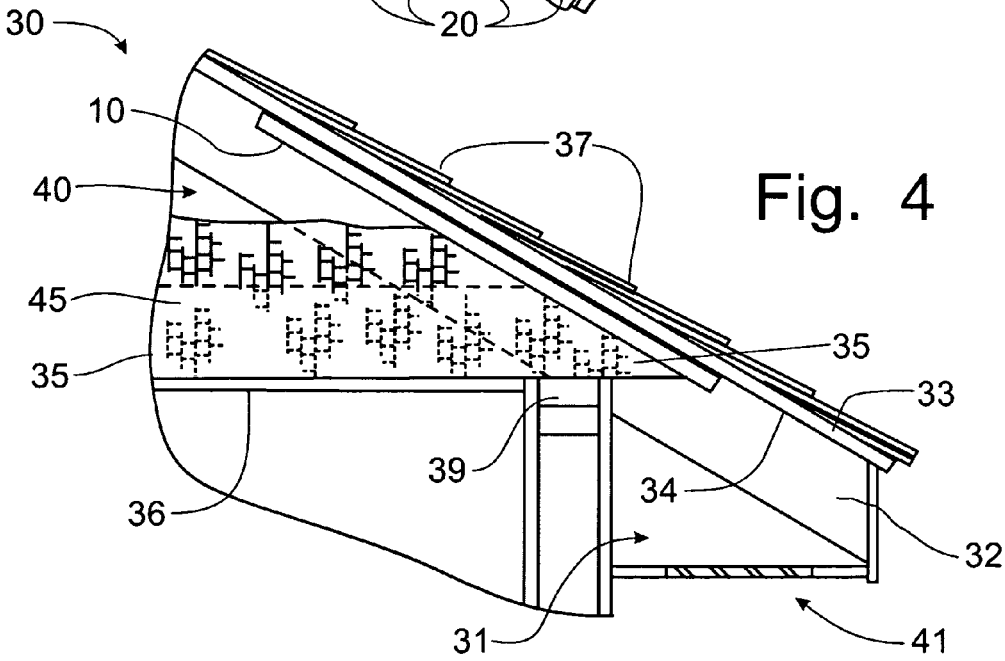
FIG. 4 is a partial schematic cross-sectional view depicting an elevational view of a representative manufactured housing structure utilizing a baffle vent according to the principles of the instant invention.
Figure 5:
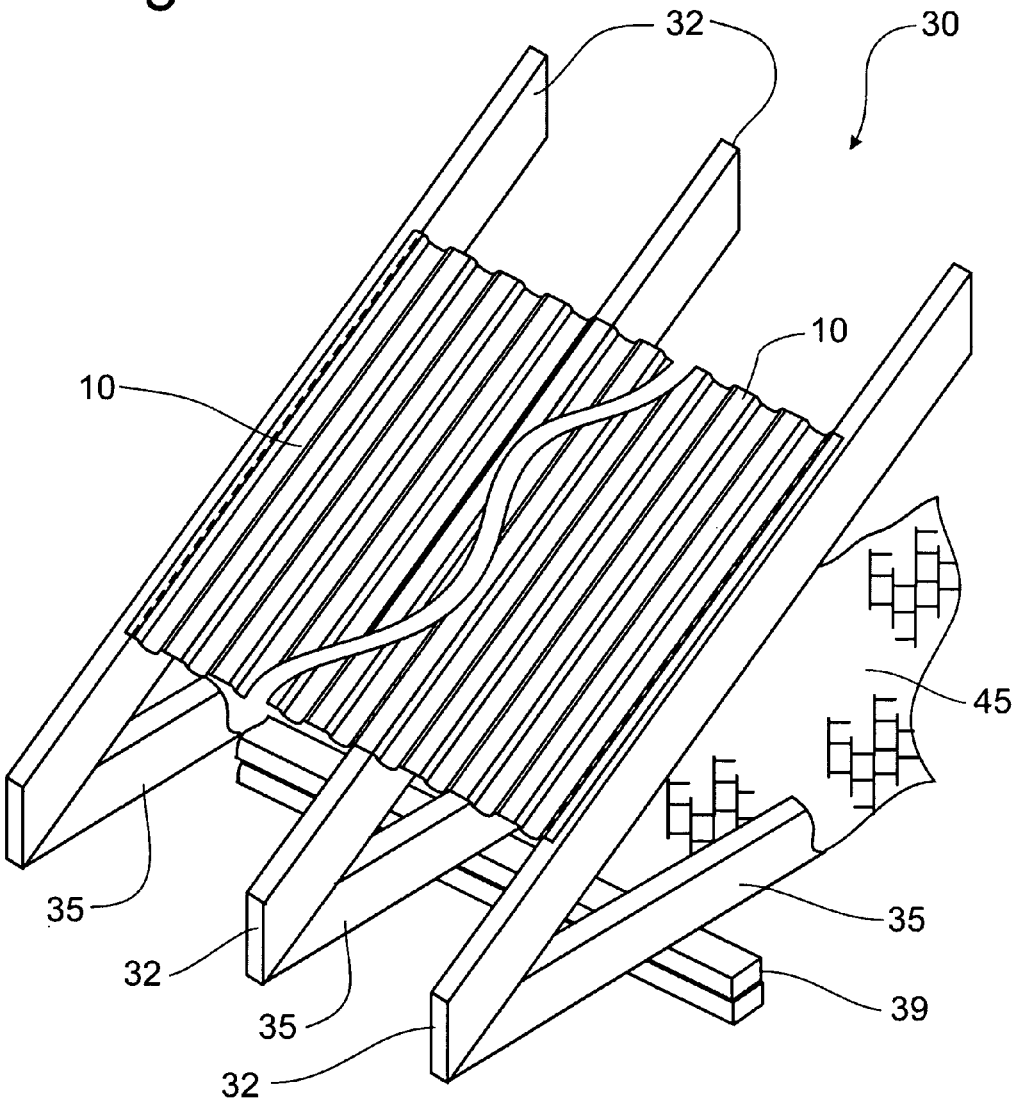
FIG. 5 is a partial perspective view of a baffle vent mounted on the rafters of a roof structure according to the principles of the instant invention.

A single segment 12 is depicted in FIGS. 1-3. The preferred dimensions of the completed baffle vent 10 are about 39 inches high by 96 inches (8 feet) wide. The formation of such a baffle vent 10 would require the molded film to be severed after the third sequential segment, to form the baffle vent 10 at a temporary width of 9 feet. A 12 inch strip would then be cut off the baffle vent to provide the final 8 foot width dimension. The removed strip would then be recycled. Alternatively, the baffle vent could be formed at a 12 foot width which would correspond to four sequential segments before being severed without any waste to be recycled. Research has shown, however, that the 8 foot width is preferred in use because of the handling requirements and associated difficulties of transporting and installing the larger 12 foot wide baffle vent 10. One skilled in the art will recognize that the size of the mold will depend on the physical parameters of the machinery operating the mold. Accordingly, other segment sizes are within the scope of the invention. For example, the width of the baffle vent 10 could be 10 feet so that a fifty foot long structure could be covered by five baffle vents mounted end to end. With the thickness of the material being at about 12 mils, the baffle vent 10 can be easily trimmed at the last rafter or simply overlapped.

As can be seen in the drawings, the baffle vent 10 is formed with a series of parallel, longitudinally extending ribs 15 separated by a valley 20 defining an overall depth of the baffle vent 10. The ribs 15 are spaced at four inch centers to provide the ability to be mounted on either sixteen or twenty-four inch roof rafter 32 spacings. With an eight foot width, the baffle vent 10 would span across seven roof rafters 32 placed at sixteen inch centers, and five roof rafters 32 placed at twenty-four inch centers, with the lateral edges 13 of the baffle vent being mounted on two end rafters 32 and either five or three intermediate roof rafters 32, depending on the spacing.

Figure 6:
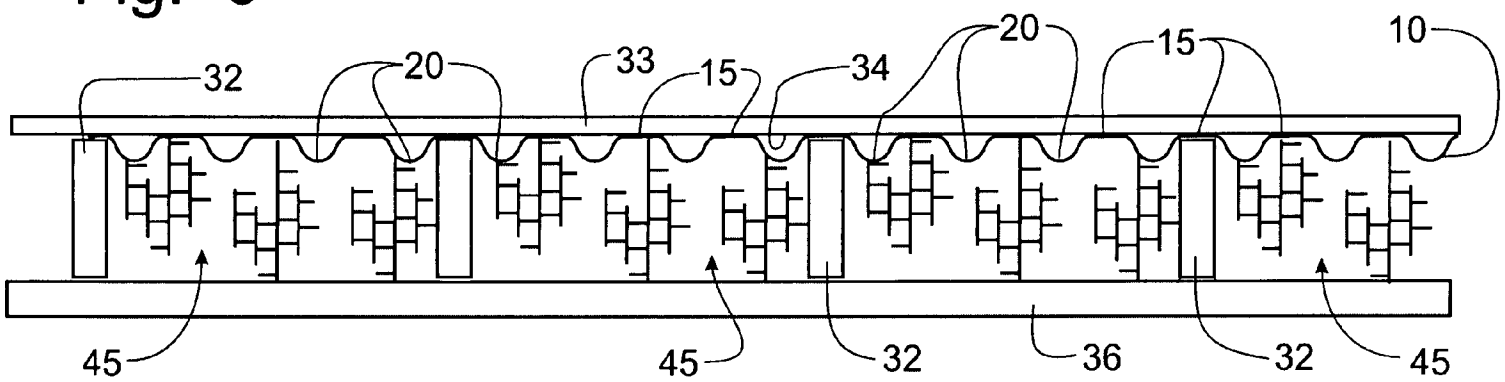
FIG. 6 is an end elevational view of a portion of baffle vent depicted in FIG. 5 at the wall top plate, looking in the orientation of the installed baffle vent.
Figure 7:
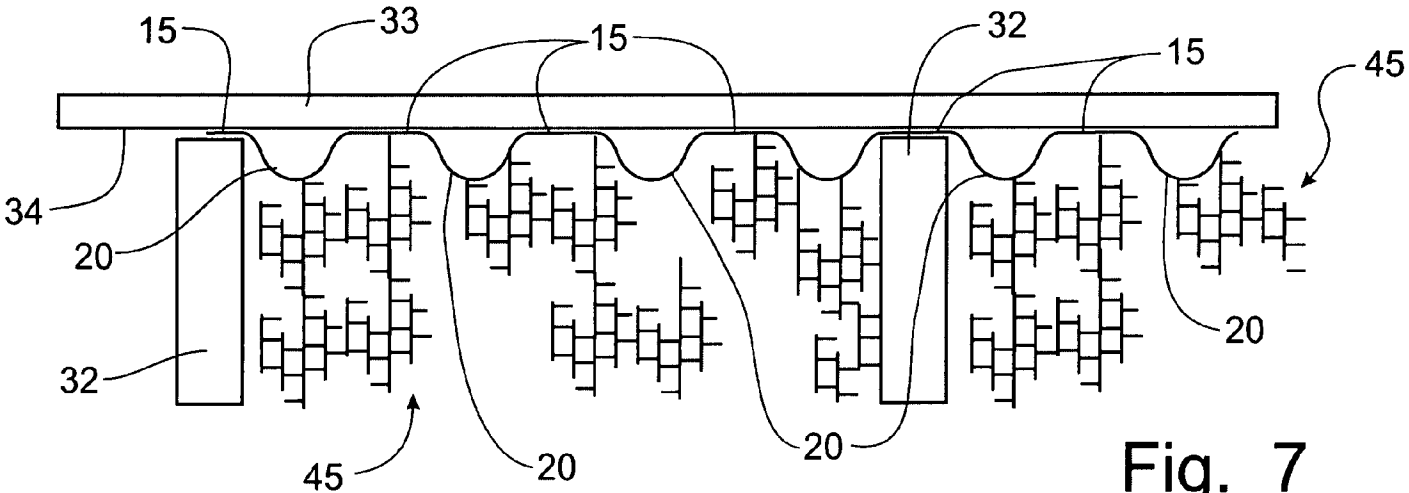
FIG. 7 is an enlarged end elevational view of a portion of the structure shown in FIG. 6.

Each longitudinally extending rib 15 is formed with a flat top surface 17 having a width of approximately one and one-half inches to mate with the nominal width of the top surface of a roof rafter 32, whether the roof rafter 32 is formed from 2×6, 2×8, or 2×10 lumber, as is best seen in FIGS. 6 and 7, except for the two end ribs 15 along each transverse edge of the baffle which are intended to span about half the rafter width to mate with an adjoining baffle 10. Each valley 20 between the longitudinally extending ribs 15 is preferably formed in a semi-circular configuration to provide strength in cross-section to resist the expansive forces of the insulation materials, such as expanding foam insulation. Thus, each valley 20 has a rounded bottom surface 22 that is spaced vertically approximately one inch from the top surface 17 of the adjacent ribs 15. Each valley 20 extends along the circular arc having a preferred radius of approximately seven-eighths of an inch from the center of the rounded bottom surface 22 through an angular deflection of approximately 68.5 degrees in each direction from the center of the bottom surface 22, measured from the tangent at the center of the rounded bottom surface 22, whereupon the valley 20 begins a reverse bend along a radius of approximately three-eighths of an inch to join with the horizontal, flat top surface 17 of the rib 15 on either side of the valley 20.

The above-described pattern is repeated on four inch intervals measured from the center of the flat top surface 17 of one rib 15 to the center of the flat top surface 17 of the next adjacent rib 15, and consequently from the center of the rounded bottom surface 22 of each valley 20 to the center of the rounded bottom surface 22 of the next adjacent valley 20. With this particular configuration of ribs 15 and valleys 20, the baffle vent 10 can also mate with any oddly spaced roof rafter 32, so long as the spacing from the next adjacent roof rafter 32 is a multiple of four inches. As an example, the end roof rafter 21 on a roof structure is not always placed at the same sixteen or twenty-four inch spacing as the remaining roof rafters 32, because the overall length of the roof is not divisible by four feet. In such situations, the end rafter 32 will typically have an end spacing of eight, twelve or twenty inches. The baffle vent 10 can easily accommodate such an odd end spacing with a rib 15 that will mate with the top surface of the end roof rafter 32.

The configuration of the end elevation of the baffle vent 10, as is best seen in FIGS. 2, 6 and 7, is such that the arched valleys 20 are supported by the adjacent ribs 15 that are pressed against the underside 34 of the roof sheeting 33 and present an arch to resist the forces exerted by the insulation that is pushing the baffle vent 10 against the underside 34 of the roof sheeting 33. The arched shape provides a strong geometric shape that is resistant to collapse. Because the flat top surfaces 17 of the ribs 15 are typically pressed against the underside 34 of the roof sheeting 33 by the forces exerted by the engaged insulation material, each longitudinally extending rib 15 can be formed with a transversely extending relief depression 19 that provide a transversely extending path for any moisture to drain from between the rib 15 and the roof sheeting 33 and for air to pass from one valley 20 to the adjacent valley 20.

Where the ribs 15 are mounted on a roof rafter 32, the pressure exerted by the fastening of the roof sheeting 33 onto the roof rafter 32 through the baffle vent 10 will flatten the small relief depression 19. The relief depressions 19 are shown in a representative manner only in FIGS. 1 and 2. The actual location and positioning of the relief depressions 19 are a matter of design choice; however, the relief depressions 19 should not be aligned across the transverse width of the baffle vent 10, which would make the handling of the baffle vent 10 more difficult as the baffle vent 10 would tend to bend across the aligned relief depressions 19.

As best seen in FIGS. 4-7, the typical roof structure is formed with ceiling joists 35 that function as attic floor joists and are oriented horizontally to support a ceiling structure 36 attached to the underside of the joists 35. The roof rafters 32 are typically connected to the ends of the ceiling joists 35 and project upwardly therefrom at a prescribed angle to meet at an apex, forming with the ceiling joists 35 a conventional triangular configuration. The roof sheeting is then fastened to the top surfaces of the roof rafters 32 to form the roof structure 30. The ceiling joists 35 and the roof rafters 32 may be supplied as a pre-assembled roof truss assembly having internal braces (not shown), or alternatively may be assembled at the construction site, and spaced at sixteen or twenty-four inch centers.

The roof rafters 32 will extend downwardly past the ceiling joists 35 to form the eaves or soffits 31, which are formed with vents 41 to allow air to flow into the soffits from the outside. The roof rafters 32 and the ceiling joists 35 typically rest on the wall top plate 39. After the roof sheeting 33 is attached to the roof rafters 32, the roofing surface, usually fiberglass shingles 37, are attached to the upper side of the roof sheeting 33 to complete the construction of the roof structure. One of ordinary skill in the art will recognize that a roof vent (not shown) is usually placed at the apex of the roof to permit the movement of air from the attic 40.

Insulation 45 in the desired form is placed between and above the ceiling joists 35 to insulate the living area beneath the ceiling joists 35. The ceiling material 36 will retain the insulation in the attic 40. Preferably, the insulation 45 extends to the joinder of the roof rafters 32 and the ceiling joists 35 without extending into the soffits. The baffle vent 10 described above is positioned between the insulation 45 and the underside 34 of the roof sheeting 33, as will be described in greater detail below. Air can then flow from the outside through the vents 41 in the soffit 31 through the valleys 20 in the baffle vent 10 defining passageways through the insulation 45 barrier along the underside 34 of the roof sheeting 33 into the attic 40 above the insulation. The air can then discharge through the roof vent (not shown).

For the preferred use in manufactured housing, the baffle vent 10 is placed on top of the roof rafters 32 before the roof sheeting 33 is placed on the rafters 32. The baffle vent 10 need only extend along the roof sheeting 33 for a length that is greater than the height of the insulation 45 along the roof sheeting 33. For most insulation 45 configurations, a length of 39 inches is more than sufficient to extend into the attic 40 above the insulation 45. The baffle vent 10 formed according to the principles of the instant invention does not require fastening to the tops of the roof rafters 32 when being installed. The formed shape of the PVC film provides a gripping tension in the baffle vent 10 to retain position on the roof rafters 32 without requiring fasteners. Furthermore, the properties of the PVC film stretched over multiple roof rafters along the 8 foot transverse width of the baffle vent 10 keeps the portions of the baffle vent 10 between adjacent roof rafters 32 from sagging. Once the baffle vent has been mounted on top of the roof rafters 32, the roof sheeting 33 can then be installed on top of the baffle vent 10 and on top of the roof rafters 32 beyond the baffle vent 10. The fasteners used to attach the roof sheeting 33 to the roof rafters 32 will easily pass through the baffle vent 10 and retain the baffle vent 10 in the desired location.

Referring now to FIGS. 8 and 9, an alternative embodiment of the baffle vent 10 can be seen. By forming the material with transversely extending ridges 25 that extend across the ribs 15 and valleys 20 from one transverse end of the baffle vent 10 to the other, the baffle vent 10 acquires a substantial amount of stiffness to permit the baffle vent 10 to be more easily handled and installed. This convoluted cross-sectional shape, as is best seen in FIG. 9, establishes raised ridges 25 projecting upwardly from the flats 27 between the ridges, preferably at a height of approximately 60 mils. Accordingly, the convoluted cross-sectional shape of ridges 25 and flats 27 extending along the ribs 15 where mounted on the rafters 32 also provides for many relief depressions at the flats 27 along the length of the rafter 32 for the escape of moisture that might collect between the baffle vent 10 and the rafter 32 into the adjacent valley for discharge from the structure.

Since the insulation, particularly expanded foam insulation often utilized in manufactured housing, will push the baffle vent panel 10 upwardly against the roof sheeting 33 between the rafters 32, the longitudinally extending ribs 15 will engage the roof sheeting 33, as depicted in FIGS. 6 and 7, with the rounded valleys 20 providing the passageway for the movement of air from the soffit 31 to the roof vent. The flats 27 in the ribs 15 between the rafters 32 allow moisture to escape from between the ribs 15 and the roof sheeting 33 into the adjacent valleys 20 for escape to the roof vent. With this configuration of the baffle vent 10 with transverse ridges 25 running from one transverse edge of the baffle vent panel 10 to the other transverse edge, the baffle vent 10 is sufficiently stiff to allow for ease of handling and a quick deployment onto the roof rafters 32 during manufacture of the building, and the ridges 25 provide a contact point against the roof sheeting 33 that minimizes the direct contact between the baffle vent 10 and the roof sheeting 33, whether between the sheeting 33 and the rafter 32 or against the sheeting 33 between the rafters 32.

Referring now to FIGS. 10-16, an insulation block member 50 cooperable with the baffle vent 10 to establish a containment area between the ceiling joists 35 to keep the insulation from infiltrating the soffit area 31 in manufacturing housing construction. The insulation block member 50 is preferably formed from polyvinyl chloride (PVC) film (not shown) having a thickness of about 12 to 16 mils through a conventional vacuum molding process in which the film is placed over a mold (not shown) and heated, as described above with respect to the baffle vent 10. The insulation block member 50 is preferably configured as a generally planar member 50 having vertical ridges 52 formed in a spaced-apart relationship along the transverse width thereof. The ridges 52 substantially increase the rigidity of the member 50 and provide the necessary resistance to bending when the insulation block member 50 is installed, as indicated in greater detail below. As with the baffle vent 10 depicted in FIGS. 8 and 9, the ridges 52 preferably have a depth of about 60 mils, which has shown to provide satisfactory results.

The insulation block member 50 is formed with a top edge 53 that has curved depressions 54 cut into the member 50, leaving at each laterally opposing side a height indicator 55 that will enable the person installing the insulation block member 50 to properly position the member 50 before attaching the member to the wall top plate 39, as will be indicted in greater detail below. With the depressions 54 properly formed in the top edge 53, the resulting shape will mate against the underside of the baffle vent 10 with the rounded bottom surfaces 22 of the valleys 20 thereof sitting within the depressions 54. Preferably, the insulation block member 50 will have a vertical height that is in the range of 10-15 inches so that the insulation block member 50 can be utilized in different forms of building construction. Because of the need to mate with the baffle vent 10 when properly installed, the insulation block member 50 is preferably formed in either a 16 inch center configuration or a 24 inch center configuration. In the 16 inch center configuration, the insulation block member would have a transverse width of approximately 14½ inches to fit between ceiling joists formed with dimensional lumber placed on 16 inch centers.

As can be seen in FIGS. 12-16, the insulation block member 50 is installed on the exterior of the wall top plate 39 in a manufactured housing environment. The insulation block member 50 would be positioned between adjacent ceiling joists 35 with the height indicators 55 positioned at the top surface of the rafters 32 onto which the baffle vent 10 will be mounted, as described above. With the height indicators 55 properly positioned, the installer staples or nails the insulation block member 50 to the wall top plate 39 with the ridges 52 preferably projecting toward the outside of the building structure to fix the insulation block member 50 in a vertical orientation affixed to the exterior of the wall top plate 39. Insulation can then be blown in or injected between the ceiling joists 35 up against the insulation block member 50, as is depicted in FIG. 13. The vertically oriented strengthening ridges 52 provide sufficient strength to allow the insulation block member 50 to resist bending outwardly.

Figure 16:
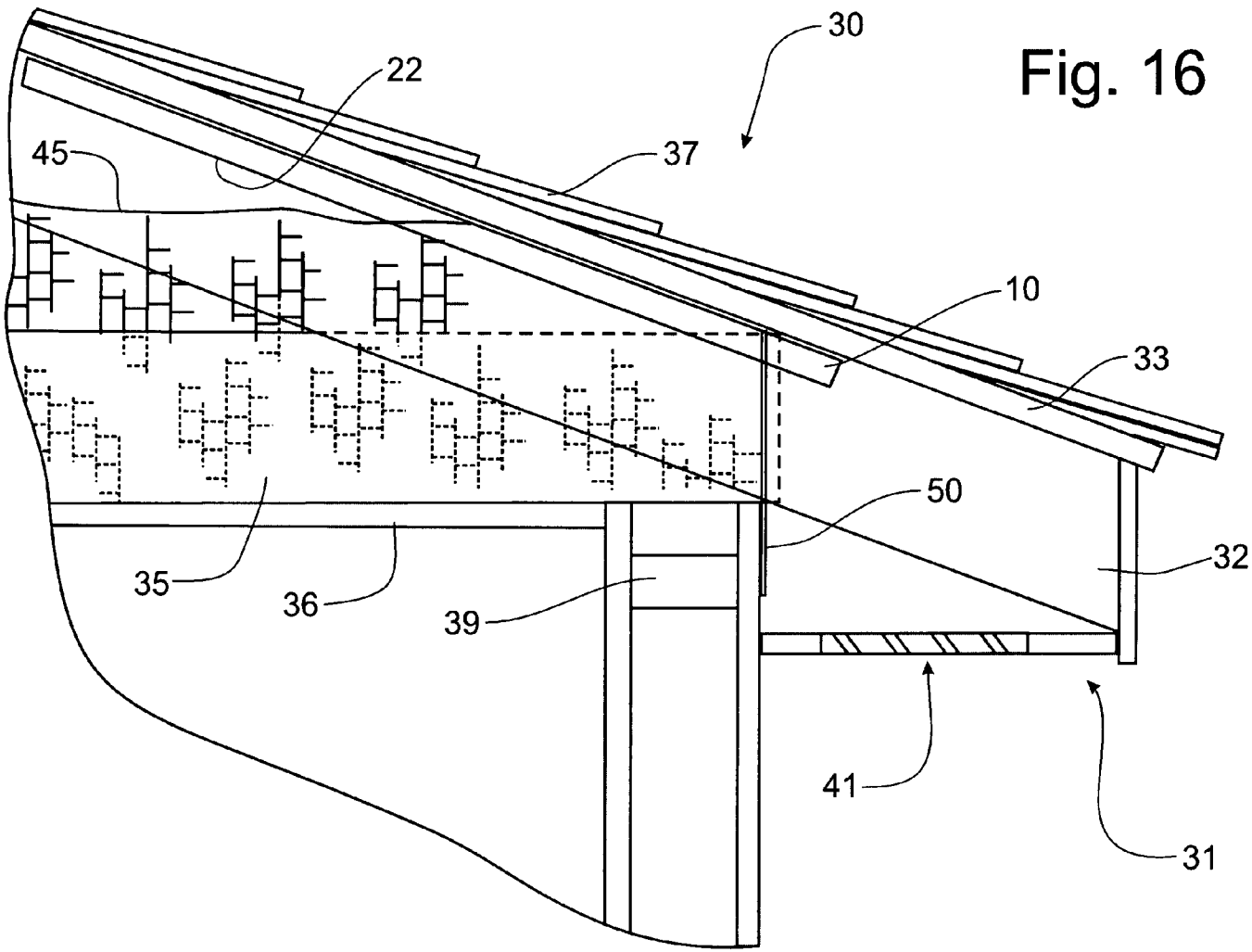
FIG. 16 is a partial schematic cross-sectional view depicting an elevational view of a representative manufactured housing structure utilizing an insulation block member engaged with a baffle vent according to the principles of the instant invention to prevent insulation from infiltrating the soffit while establishing a flow path for ventilation air from the soffit past the insulation layer.

As is shown in FIG. 14, the baffle vent 10 can then be installed on top of the rafters 32, as described above, with the valleys 20 of the baffle vent 10 resting in the depressions 54 on the top edge 53 of the insulation block member 50, and the flat top surface 17 of the baffle vent 10 mounted on top of the rafters 32. With the configuration of the baffle vent 10 having transverse strengthening ridges 25, as depicted in FIGS. 8 and 9, the baffle vent 10 would be positioned on top of the insulation block member 50 with the top edge 53 of the member 50 being positioned between two strengthening ridges 25. With the ridges 25 projecting approximately 60 mils below the top edge 53, the insulation block member 50 becomes interlocked with the baffle vent 10, the lowermost adjacent ridge 25 with respect to the top edge 53 restraining an outward deflection of the insulation block member 50. Accordingly, where the insulation layer 45 is to be thicker than the height represented by the insulation block member 50, as is depicted in FIG. 16, the baffle vent 10 is installed on the rafters 32 before the insulation is blown in or injected between the joists 35. As depicted in FIG. 15, the roof sheeting 33 is typically installed on top of the rafters 32 and on top of the baffle vent 10 after the insulation layer 45 is installed into the building structure.

As is best seen in FIG. 16, the combination of the insulation block member 50 engaged with the baffle vent 10 establishes a containment area for the insulation between the ceiling joists 35 inwardly of the wall top plate 39 and above the living area of the building structure. With the insulation prevented from infiltrating the soffit area 31, a clear flow path is established for ventilation air passing through the soffit vents 41 and through the valleys 20 of the baffle vent 10 to be discharged from the attic above the insulation layer 45. This baffle vent 10 and insulation block member 50 combination is particularly adapted for use in conventional manufactured housing environments in which the insulation block member 50 can be mounted on the outside of the wall top plate 39 before the roof is completed by the installation of the roof sheeting 33, with the top edge 53 of the insulation block member 50 supported by the strengthening ridges 25 of the baffle vent 10.

While PVC film is the preferred material from which the baffle vent 10 and the insulation block member 50 are formed through the thermal molding, vacuum forming manufacturing process, one of ordinary skill in the art will recognize that other materials may be used in the manufacture of the baffle vent 10 and the insulation block member 50. Sheet metals, thermoplastics, and composite materials composed of fibers impregnated with thermoplastic materials can all be used to form the vent baffle 10 and the insulation block member 50. Sheet metals such as galvanized steel, stainless steel, aluminum and copper can be formed into vent baffles for use in the present invention. Thermoplastic materials which can be used in the present invention in addition to PVC film are, for example, polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used may be dependent upon the desired end use and the application conditions associated with that use, as is well known in the art.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An insulation block for use in conjunction with a baffle vent for manufactured housing having roof rafters covered by roof sheeting and supported on a wall having a top wall plate, said baffle vent including transverse stiffening ridges extending across longitudinally extending ribs and valleys formed in said baffle vent, said top wall plate having a vertical interior surface and a vertical exterior surface, comprising:

a plastic film panel having an upper portion terminating in an upper edge and a lower portion terminating in a lower edge, said upper edge and said lower edge defining a height dimension of said panel and first and second transversely spaced side edges defining a width dimension of said panel, said width dimension being sized to fit between adjacent said roof rafters;

said upper edge being formed with a shaped configuration conforming to said ribs and valleys of said baffle vent so that said upper edge will mate against the ribs and valleys of said baffle vent extending between adjacent roof rafters, said lower portion being positioned along said vertical exterior surface of said top wall plate to be affixed thereto such that said insulation block being secured only by fasteners affixing said lower portion to said vertical exterior surface of said top wall plate, said upper edge being restrained from movement outwardly toward said vertical exterior surface of said top wall plate through an interference engagement between a first and second of said transverse stiffening ridges of said baffle vent; and vertical ridges formed in said panel across said width dimension to stiffen said panel with respect to bending in response to weight of insulation placed against said panel.

2. The insulation block of claim 1 wherein said shaped configuration of said upper edge is formed with alternating flat ribs and rounded valleys spaced uniformly along said upper edge and extending transversely from said first side edge to said second side edge.

3. A combination baffle vent and insulation block for maintaining a passageway between roof rafters of a building and insulation material for a flow of air from a soffit to a roof vent past insulation material installed between said roof rafters which are covered by roof sheeting, said roof rafters being supported on a wall having a top wall plate, said top wall plate having a vertical interior surface and a vertical exterior surface, comprising:

a baffle vent panel having first and second longitudinally spaced ends defining a length dimension of said baffle vent panel and first and second transversely spaced sides defining a width dimension of said baffle vent panel;

said baffle vent panel being formed with ribs and valleys extending longitudinally from said first end to said second end, each said rib being positioned for engagement with a rafter, at least one valley being positioned between said ribs to establish said passageway, said at least one valley defining a shaped configuration of said baffle vent panel between adjacent said roof rafters;

a plurality of transverse stiffening ridges extending from said first edge to said second edge, said ridges being uniformly spaced along said length dimension from said first longitudinally spaced end to said second longitudinally spaced end, a first and a second of said stiffening ridges being located at said first end; and an insulation block panel formed independently from said baffle vent panel and being attached by fasteners through a lower portion of said insulation block panel to said vertical exterior surface of said top wall plate, said insulation block panel having an upper edge formed with said shaped configuration to mate with said baffle vent panel, said upper edge being engaged between said first and second stiffening ridges to interlock said upper edge between said first and second stiffening ridges to restrain movement of said upper edge toward said soffit, said insulation block being only secured by fasteners connecting said lower portion to said vertical exterior surface of said top wall plate.

4. The combination of claim 3 wherein said insulation block panel is formed with vertical stiffening ridges extending from said upper edge to a lower edge attached to said top wall plate.

5. The combination of claim 4 wherein said insulation block panel includes first and second side edges that define a width dimension substantially equal to a spacing dimension between adjacent roof rafters.

6. The combination of claim 5 wherein said upper edge of said insulation block panel engages said baffle vent panel between said first and second ends thereof.

7. The combination of claim 6 wherein said baffle vent panel includes a plurality of valleys located between said adjacent rafters, each adjacent pair of said valleys being separated by a rib such that said ribs and valleys alternate, said shaped configuration of said upper edge off said insulation block panel being formed with a corresponding number of ribs and valleys to permit said upper edge of said insulation block panel to mate with said baffle vent panel between said adjacent roof rafters.

8. The combination of claim 7 wherein said width dimension of said baffle vent panel is sufficiently large as to span a plurality of roof rafters.

9. The combination of claim 8 wherein a separate one of said insulation block panels is provided between each pair of adjacent roof rafters.

10. The combination of claim 9 wherein said baffle vent panel is placed on top of said plurality of roof rafters before said roof sheeting is applied to said roof rafters such that said baffle vent panel is positioned between said roof rafters and said roof sheeting.

11. The combination of claim 10 wherein said upper edge of said insulation block panel is engaged with said baffle vent panel and said lower edge is attached to said top wall plate prior to said roof sheeting being applied to said roof rafters.

12. A roof for manufactured housing, said roof being supported on walls of said manufactured housing having a top wall plate, said top wall plate having a vertical interior surface and a vertical exterior surface, comprising:

a plurality of transversely spaced roof rafters covered by roof sheeting;

a baffle vent panel located between said roof rafters and said roof sheeting, said baffle vent panel spanning at least three roof rafters, said baffle vent panel having first and second longitudinally spaced ends defining a length dimension of said baffle vent panel and first and second transversely spaced sides defining a width dimension of said baffle vent panel;

said baffle vent panel being formed with alternating ribs and valleys spaced uniformly and extending longitudinally from said first end to said second end, each said rib having a generally flat configuration defining a transverse width dimension substantially equal to a corresponding width dimension of said roof rafters, said valleys being rounded;

said baffle vent panel being further formed with transverse stiffening ridges extending from said first transverse edge to said second transverse edge, a first and a second of said stiffening ridges being located at said first end; and an insulation block panel corresponding to each space between adjacent roof rafters spanned by said baffle vent panel, each said insulation block panel being formed independently from said baffle vent panel, said insulation block panel having an upper portion terminating in an upper edge engaged with said baffle vent panel between said first and second stiffening ridges to trap said upper edge between said first and second stiffening ridges to restrain said upper edge from movement outwardly vertical exterior surface of said top wall plate, each said insulation block further having a lower portion attached by fasteners to said vertical exterior surface of said top wall plate, said upper edge of said insulation block being formed with a shaped configuration corresponding to said alternating ribs and valleys to mate with said baffle wall panel, whereby said insulation block is secured by fasteners affixing said lower portion to said vertical exterior surface of said top wall plate.

13. The roof of claim 12 wherein said insulation block panel is formed with a plurality of vertical stiffening ridges extending from said upper edge to an opposing lower edge of said lower portion.

14. The roof of claim 13 wherein said insulation block panel includes first and second side edges that define a width dimension substantially equal to a spacing dimension between adjacent said roof rafters.

15. The roof of claim 14 wherein said width dimension of said baffle vent panel is sufficiently large as to span a plurality of roof rafters, a separate one of said insulation block panels being provided between each pair of adjacent said roof rafters.

16. The roof of claim 15 wherein said baffle vent panel is placed on top of said plurality of roof rafters before said roof sheeting is applied to said roof rafters such that said baffle vent panel is positioned between said roof rafters and said roof sheeting.

* * * * *